US011712086B1

(12) United States Patent
Garcia et al.

(10) Patent No.: US 11,712,086 B1
(45) Date of Patent: Aug. 1, 2023

(54) TEMPERATURE REGULATING INSOLE

(71) Applicant: ASCENT SPORTING INNOVATIONS, INC., Abingdon, MD (US)

(72) Inventors: Thunlwyn Thee Garcia, Abingdon, MD (US); Garth Edward Patterson, Jefferson, MD (US); Dennis Augusto Garcia, Abingdon, MD (US); Anthony Joseph Milazzo, Lancaster, PA (US)

(73) Assignee: Ascent Snorting Innovations, Inc., Abindgon, MD (US)

( * ) Notice: Subject to any disclaimer, the term of this patent is extended or adjusted under 35 U.S.C. 154(b) by 0 days.

(21) Appl. No.: 17/990,080

(22) Filed: Nov. 18, 2022

(51) Int. Cl.

| | |
|---|---|
| ***A43B 7/02*** | (2022.01) |
| ***A43B 17/00*** | (2006.01) |
| ***A43B 7/00*** | (2006.01) |
| ***A43B 13/18*** | (2006.01) |

(52) U.S. Cl.
CPC ..... *A43B 17/00* (2013.01); *A43B 7/005* (2013.01); *A43B 7/02* (2013.01); *A43B 13/189* (2013.01)

(58) Field of Classification Search
CPC ..... A43B 17/00; A43B 7/00; A43B 7/005; A43B 7/02; A43B 7/34; A43B 13/189
USPC ..... 36/29, 43, 2.6
See application file for complete search history.

(56) References Cited

U.S. PATENT DOCUMENTS

| | | | | |
|---|---|---|---|---|
| 4,756,958 | A * | 7/1988 | Bryant | D01F 1/10 428/920 |
| 5,084,986 | A | 2/1992 | Usui | |
| 5,254,380 | A * | 10/1993 | Salyer | F16D 66/00 126/246 |
| 6,319,599 | B1 * | 11/2001 | Buckley | C09K 5/063 36/83 |
| 9,179,734 | B2 | 11/2015 | Zsolesak et al. | |
| 9,408,436 | B2 | 8/2016 | Mankowski et al. | |
| 9,548,618 | B2 | 1/2017 | Shapiro et al. | |
| 10,499,703 | B2 | 12/2019 | Sharpes | |
| 11,399,596 | B2 | 8/2022 | Mankowski et al. | |
| 2004/0043212 | A1 * | 3/2004 | Grynaeus | D06M 23/12 442/61 |
| 2007/0051018 | A1 * | 3/2007 | Issler | A43B 9/02 36/29 |
| 2008/0028637 | A1 | 2/2008 | Benfatti | |
| 2010/0015430 | A1 * | 1/2010 | Hartmann | B32B 27/08 428/323 |
| 2011/0071448 | A1 * | 3/2011 | Margiotta | A43B 5/02 521/134 |
| 2011/0155141 | A1 * | 6/2011 | Sawyer | D06M 23/08 128/846 |
| 2014/0182164 | A1 * | 7/2014 | Krupenkin | A43B 7/02 36/2.6 |
| 2016/0351771 | A1 * | 12/2016 | Schneider | A43B 3/34 |
| 2018/0027921 | A1 * | 2/2018 | Galiano | F28D 20/023 |
| 2018/0295930 | A1 * | 10/2018 | Brienza | A43B 7/144 |

(Continued)

*Primary Examiner* — Marie D Bays
(74) *Attorney, Agent, or Firm* — Venable LLP

(57) ABSTRACT

The present invention relates to an insole containing one or more cavities, wherein said one or more cavities contain a component capable of a physiochemical reaction, as well as articles of footwear containing the insole and methods of making the insole. The invention also relates to methods of heat transfer between an article of footwear and a foot of a wearer of the article of footwear, the method including priming the insole, wherein the priming initiates the physiochemical reaction.

17 Claims, 9 Drawing Sheets

(56) References Cited

U.S. PATENT DOCUMENTS

| | | | | |
|---|---|---|---|---|
| 2019/0075884 | A1* | 3/2019 | Pearce | B29D 35/0009 |
| 2020/0000175 | A1* | 1/2020 | Becerra, II | A43B 17/003 |
| 2020/0113345 | A1* | 4/2020 | DeFranks | D06M 15/263 |
| 2022/0304419 | A1* | 9/2022 | Refaeian | B29D 35/0009 |

* cited by examiner

TEMPERATURE REGULATING INSOLE

FIELD OF THE INVENTION

The present invention relates to a temperature regulating insole for an article of footwear. The insole contains one or more cavities that contain a component capable of a physiochemical reaction. The insole is useful for various applications, including, for example, sports, outdoor activities, and therapeutic applications.

BACKGROUND OF THE INVENTION

Many athletes, outdoors persons and those with certain physical ailments, such as diabetes, struggle with maintaining comfortable foot temperature due to environmental temperature, physical exertion, neuropathy, etc. In extreme cases of heat, feet are burned. In extreme cases of cold, feet are numbed. In both cases, people are in pain. The proposed insole addresses these issues by providing temperature regulating mechanisms.

To tackle cold environments, a heated insert that sits atop the standard insole is often used, but only allows for one-time use. The disadvantage of current, heated inserts is that they are typically flat and move around in the shoe. They are not immobilized within the shoe and cannot provide stability to the user.

Another mode of heating the foot is through use of a gel that is housed within a pouch. This pouch can contain various chemicals and is placed on top of the shoe's existing insole or in the arches of the existing insole. However, this pouch is difficult for the consumer to use as the pouch must be heated separately and cut to size to lay on the existing insole or attached to the existing insole manually for effective use of the product. The pouch itself is prone to movement within the shoe and the liquid chemical solution sloshes around within the pouch. Additionally, the pouch is susceptible to bursting from large weights or sudden forces because it does not have weight supporting structures and is contained within a thin, plastic material.

Historically, a common mode for heating the foot has been a heated insole that is powered by a battery. Thermoelectricity is a popular heating mechanism for cold weather events where the foot is provided with the relative stability of a stiff boot. The stiff boot allows for a battery and integrated circuitry to be housed in a hard protective container. These boots lack the necessary torsional response of more flexible athletic shoes such as cleats, running shoes, and cross trainers. For sporting events in the winter that require more dexterity, such as running, diagonal movement, and unexpected maneuvering, these battery containing boots are highly ineffective or even impossible to use. Additionally, the small lithium-ion battery case is susceptible to breaking from severe impact, which endangers the foot of the user and is not ideal.

Athletes and those with certain ailments, such as diabetes, when facing −32° F. (i.e., 0° C.) weather will often struggle and be in pain due to the cold. They feel a painful numbing sensation as they lose all feeling in their extremities. This is due to the body slowing blood flow to the extremity points in an attempt to maintain homeostatic core body temperature. This causes uncomfortable numbing, which, for athletes, renders them unable to compete in their desired sporting activity and causes them to perform poorly in this diminished state. Also, due to the extremities not receiving adequate blood flow, the body will begin to shiver in an attempt to produce heat in order to protect the extremities from frostbite. It is important to note that, in addition to the temperature of the environmental surroundings, one must also factor in the wind chill experienced by the individual, which causes further decreases in core body temperature, thereby exacerbating the athlete's discomfort.

SUMMARY OF THE INVENTION

The present invention relates to an insole containing one or more cavities, wherein the one or more cavities contain at least one component capable of a physiochemical reaction. In addition, the present invention relates to articles of footwear containing the insole. The invention also provides methods of heat transfer between an article of footwear and a foot of a wearer of the article of footwear, the method including priming the insole, wherein the priming initiates the physiochemical reaction. The insole, footwear and methods are useful, for example, in sports and therapeutic applications.

Figure 4:
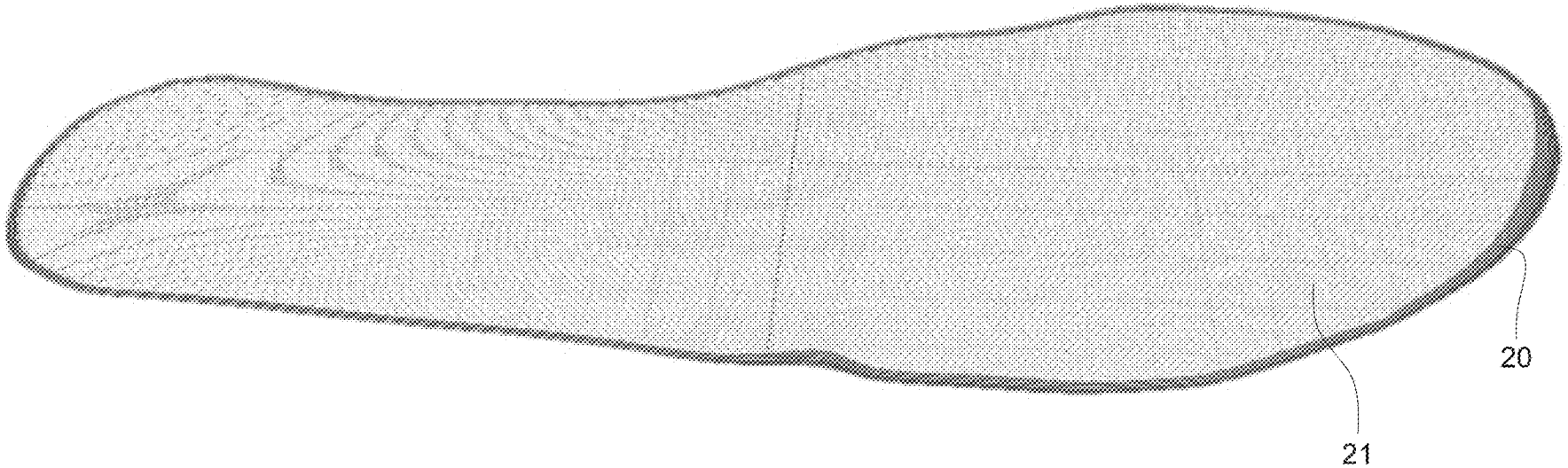

FIG. 4 depicts a layer (20) of an exemplary insole (1). The layer (20) has a surface (21). The exemplary insole has layers below the main cavities and layers above the main cavities.

Figure 5:
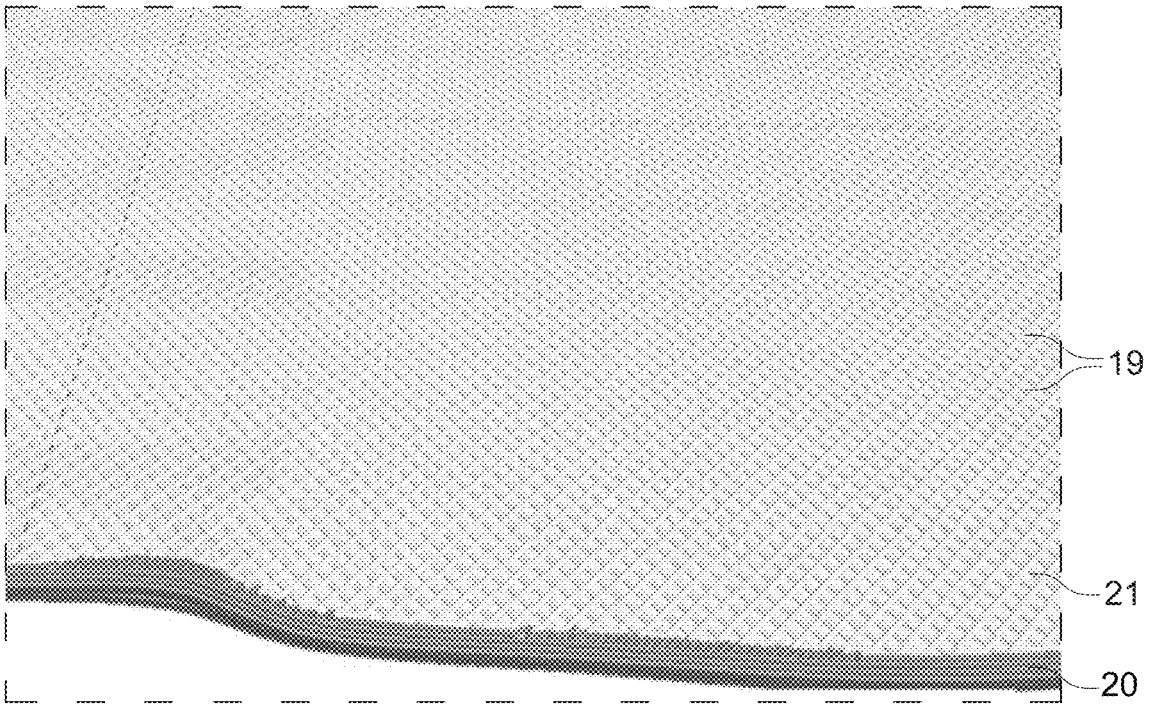

FIG. 5. depicts a close-up of spaces (19) within a surface (21) of the layer (20) of an exemplary insole.

Figure 6:
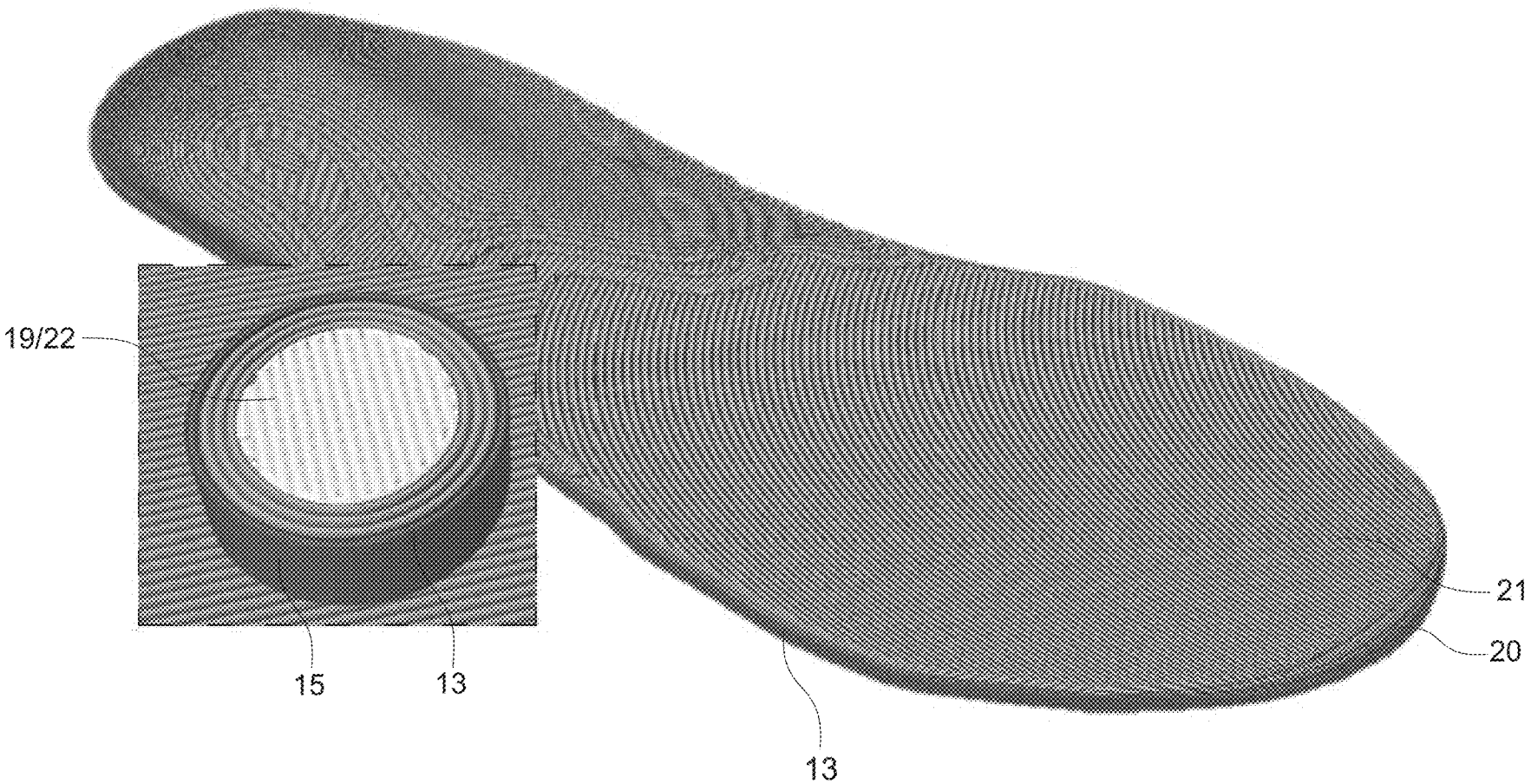

FIG. 6 depicts an exemplary reusable insole in accordance with the invention having a top surface (21) and layers (20) and further depicts an exemplary pillar (15) containing a honeycomb-structured infill (22) comprising spaces (19) enclosed by a wall (13).

Figure 7:
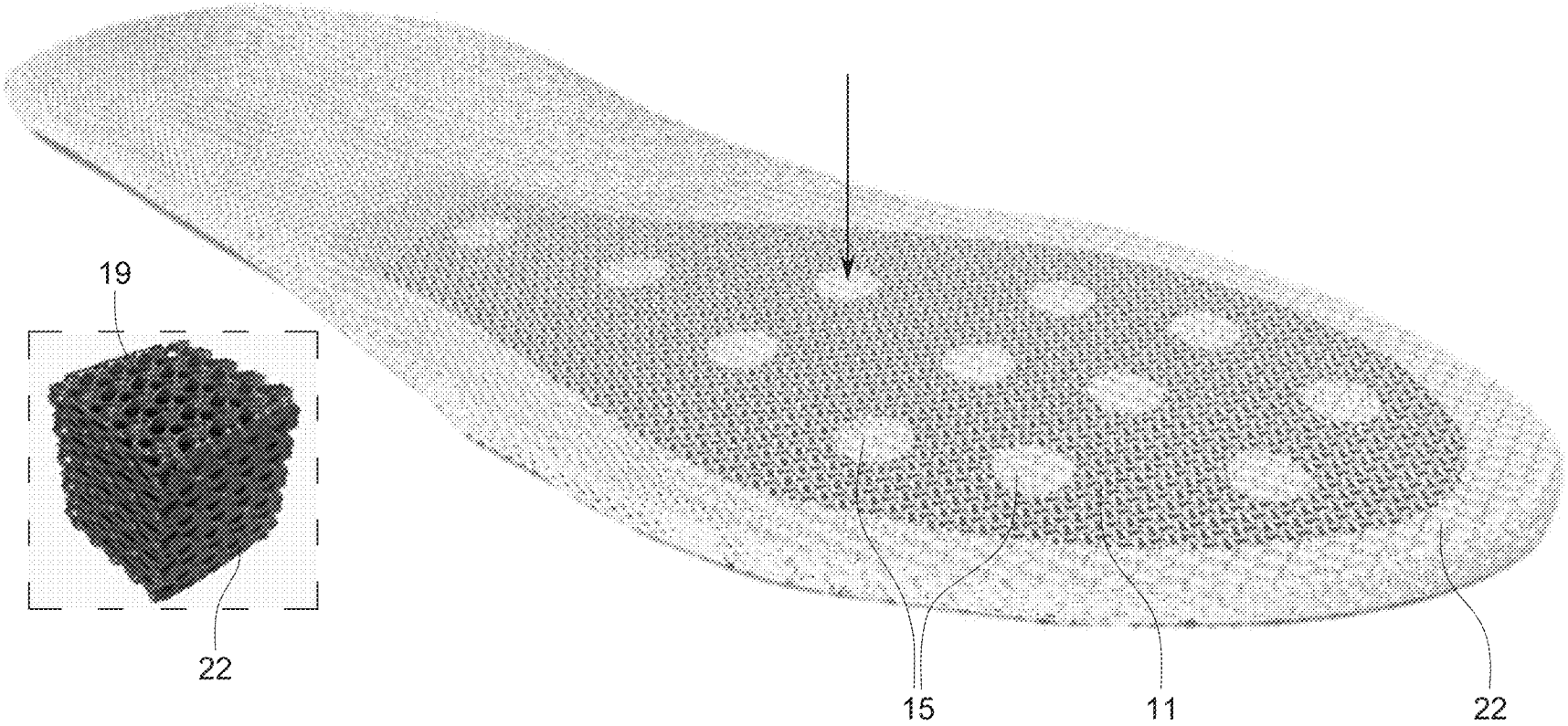

FIG. 7 depicts an exemplary non-reusable/disposable insole having a gyroid-structured infill (22) with no wall around the pillars (15), cavity (11) and insole (1) allowing airflow (arrow) throughout the permeable infill (22) of the pillar (15) reaching the cavity (11) having an impermeable infill (illustrated as a darker shade of grey) that contains the component capable of physiochemical reaction.

Figure 8:
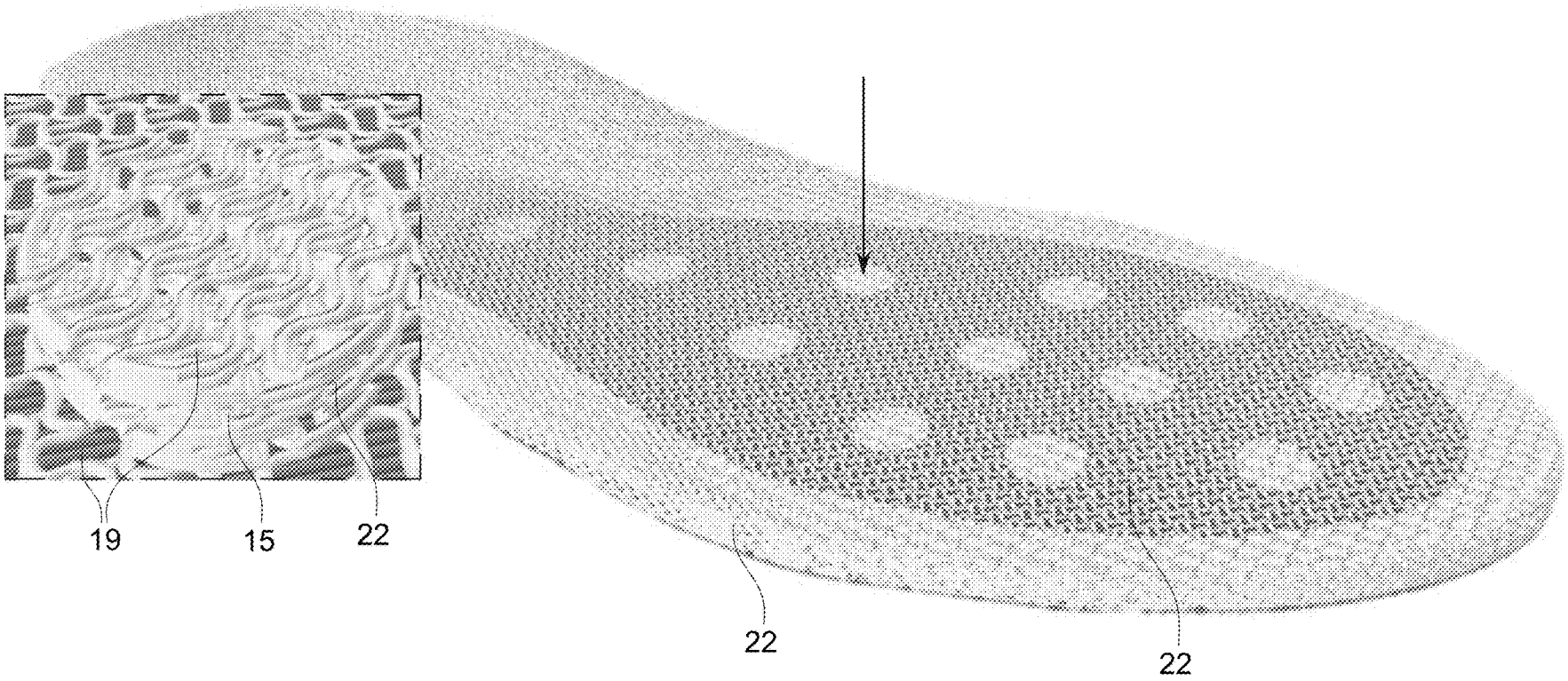

FIG. 8 depicts an exemplary non-reusable/disposable insole having a gyroid structured infill (22); an enlargement of the pillar (15) having a permeable gyroid-structured infill (22) comprising spaces (19) allowing airflow (arrow).

Figure 9A:
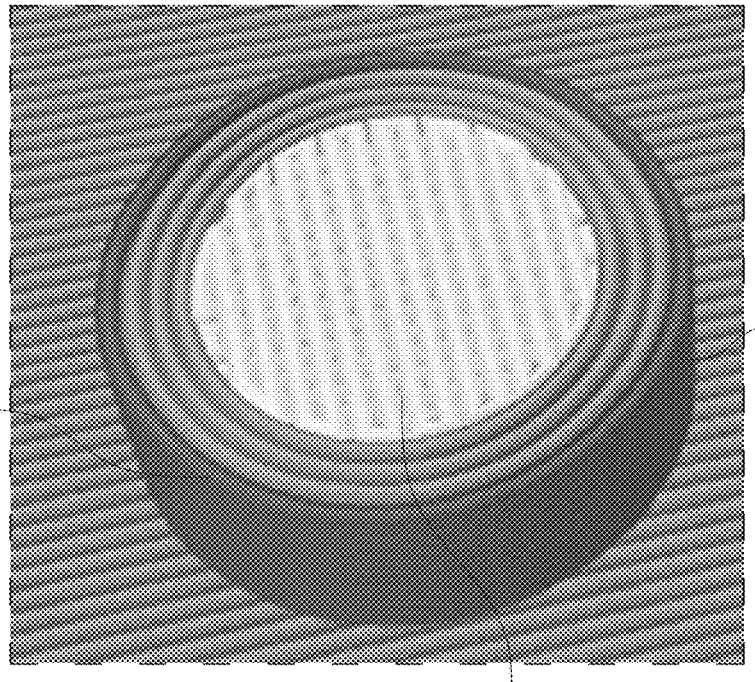
Figure 9B:
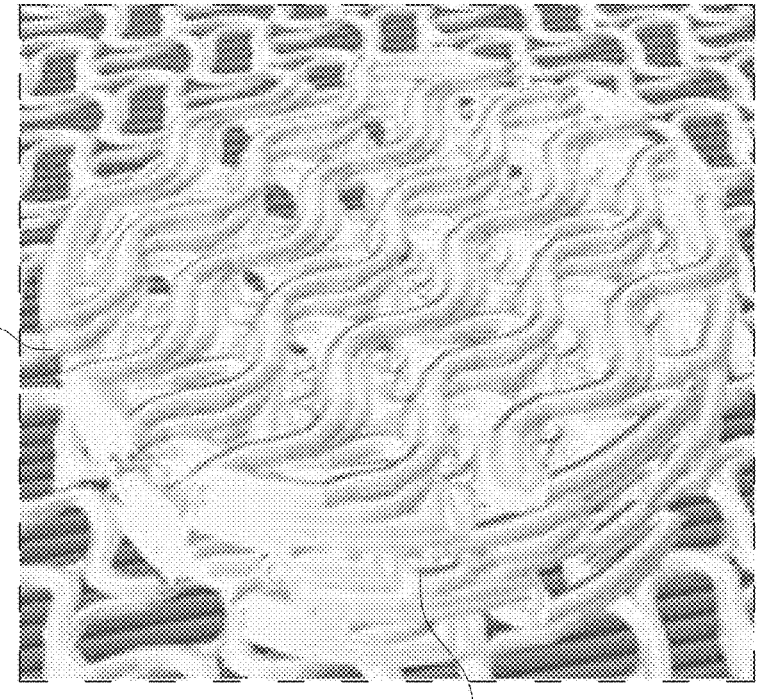

FIG. 9A-9B show a pillar (15) with distinct infill structural configurations (22). FIG. 9A is characteristic of an exemplary reusable insole wherein the honeycomb-structured infill is enclosed by a wall (13) of variable permeability. FIG. 9B shows a pillar (15) characteristic of an exemplary disposable insole wherein the gyroid-structured infill (22) is not enclosed by a wall.

DETAILED DESCRIPTION OF THE INVENTION

The invention relates to a thermal insole which can be inserted in an article of footwear such as a boot, a cleat, a sneaker, a boat shoe, a loafer, or a dress shoe.

Disclosed herein is an insole (1) containing one or more cavities (11) which contain a component capable of a physiochemical reaction. The insole (1) can be part of an article of footwear to regulate the temperature of the foot of the wearer. The insole (1) can be a separate, insertable insole, or integrated into the article of footwear. In one embodiment, the component capable of a physiochemical reaction is a latent thermal composition. The latent thermal composition may provide a thermal change upon the physiochemical reaction being realized. In another embodiment, the insole fulfills the needs of the wearer for thermal regulation and may also provide comfort and flexibility.

Figure 1:
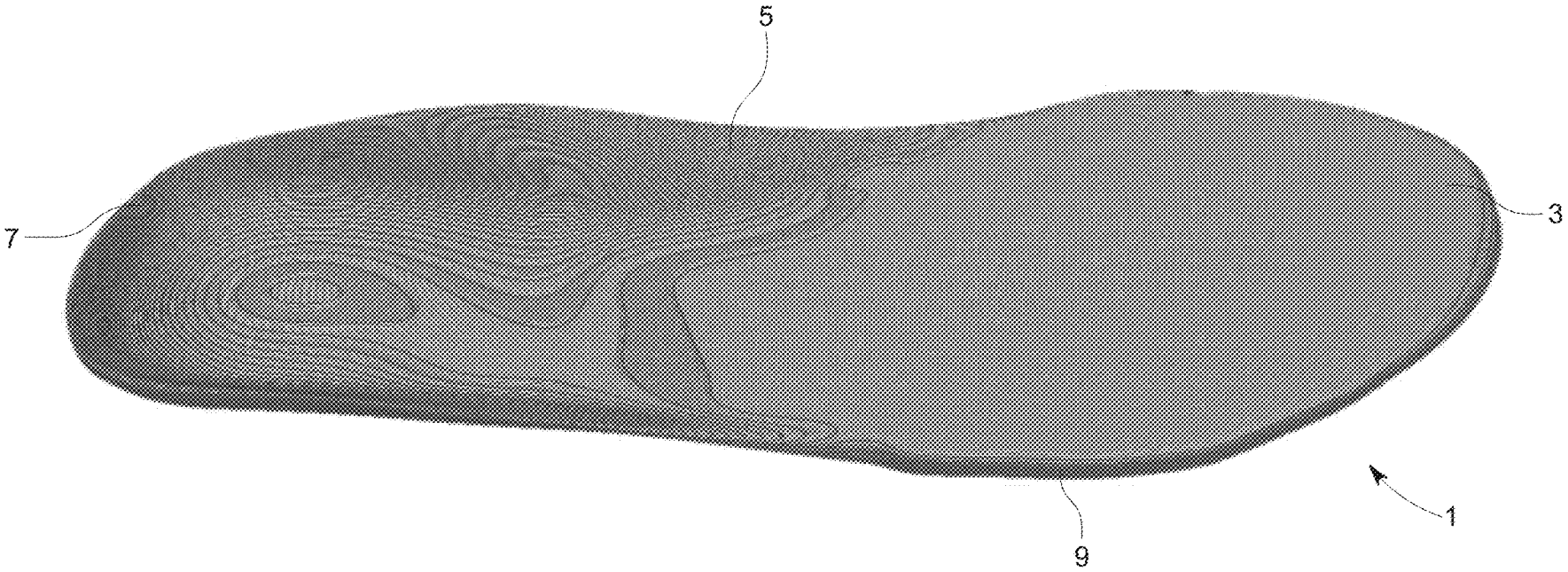
FIG. 1 depicts an exemplary insole (1) of the invention, with a front (3), a middle (5) comprising an arch, a heel (7) comprising a heel cup, and an edge (9).

The insole (1) includes a front (3) a middle (5), a heel (7), and an edge (9) in the embodiment show in FIG. 1 and is shaped into a standard shoe insert. In alternative embodiments, the insole (1) can further include ergonomic designs, including, but not limited to, an arch, a heel cup, or a curved edge. When present, the arch is preferably located in the middle (5) of the insole (1) or can span from the front (3) to the heel (7) of the insole, and provides additional support/stability to the foot of the wearer. The insole can be standard or personalized. For example, the arch may be adjusted as desired by a wearer. For example, it may be elevated to provide support to the natural arch of the feet of the wearer. The arch may also be adjusted according to the level of rigidity or flexibility the wearer requires. A firm support may help improve balance, align the spine and reduce the risk of ankle or knee injuries. However, an athlete may also require an arch that will flex with their feet. The degree of flexibility may be realized by varying the density of the layers or materials. The type of arch a wearer needs (elevation and flexibility/rigidity) may be determined by how active the wearer is when wearing the insoles. A more rigid arch may provide support while a more flexible arch will favor greater movement during activity. When present, the heel cup is located in the heel (7) of the insole (1) and stabilizes the foot of the wearer within the insole (1). For example, a deep heel cup may help stabilize the ankle and the bones of the foot further back towards the heel. Such feature may also be important to reduce the risk of inflammation such as plantar fasciitis which is common among runners. The edge (9) of the insole can be curved to help stabilize the position of the insole (1) within the article of footwear.

Cavity or cavities (11), as used in the context of the present disclosure, refer to an empty space in the insole (1) which contains the component capable of a physiochemical reaction and optionally, support structures such as baffles (17) and pillars (15). The insole (1) includes one or more cavities (11) that each may comprise one or more baffles (17) and/or one or more pillars (15).

The cavities (11) can be located in the front (3), the middle (5), or the heel (7) of the insole (1). Preferably the cavities (11) are positioned toward the front (3) to regulate the temperature of the toes of the wearer but can be positioned anywhere that is desirable to the wearer. In the embodiment shown in FIG. 2, the insole (1) has one cavity (11) that spans from the front (3) to the middle (5) of the insole (1). Alternatively, the insole (1) can have one cavity (11) that spans from the front (3) to the heel (7) of the insole (1). In alternative embodiments, the insole (1) can have two separate cavities (11) wherein one cavity (11) is located in the front (3) and a second cavity (11) is located in the middle (5); or one cavity (11) is located in the front (3) and a second cavity is located in the heel (7); or one cavity (11) is located in the middle (5) and a second cavity (11) is located in the heel (7) of the insole (1). Alternatively, the insole (1) can have two separate cavities (11), wherein one cavity (11) is located in the front (3) and a second cavity (11) spans from the middle (5) to the heel (7) of the insole (1); or one cavity (11) is located in the heel (7) and a second cavity (11) spans from the front (3) to the middle (5) of the insole (1). In yet another embodiment, the insole (1) can have three separate cavities (11), wherein one cavity (11) is located in the front (1), a second cavity (11) is located in the middle (5), and a third cavity (11) is located in heel (7) of the insole.

The depth and width of cavities (11) may be varied to accommodate the desired amount heating and cooling material. The number, location, and dimensions of cavities (11) are chosen to achieve desired properties of comfort and temperature control. Deeper and wider cavities (11) accommodate more physiochemical reactive material. Shallower and narrower cavities (11) allow outer surface thickness to increase providing more structural support.

In some embodiments, the one or more cavities (11) comprises a component capable of a physiochemical reaction. The one or more cavities have a volume that is greater than a volume of the component. As used throughout, the "component capable of a physiochemical reaction" refers to a component comprising at least one chemical that reacts either endothermically (i.e., capacity of absorbing heat energy), providing cooling, and/or exothermically (i.e., capacity to release heat energy), providing warmth. For example, the component comprises at least one phase-change material (PCM) or any other substance capable of producing an endothermic and/or exothermic reaction. In one embodiment, a "phase-change material (PCM)" refers to a material or chemical that has the capacity to store heat energy when its phase changes from solid to liquid, and release heat energy when its phase reverts from liquid to solid. As further discussed herein, the component capable of an exothermic physiochemical reaction may further comprise at least one physical kinetic inhibitor, which may tailor the duration of the reaction and/or the amount of heat release and/or the reversibility of the exothermic reaction.

Figure 2:
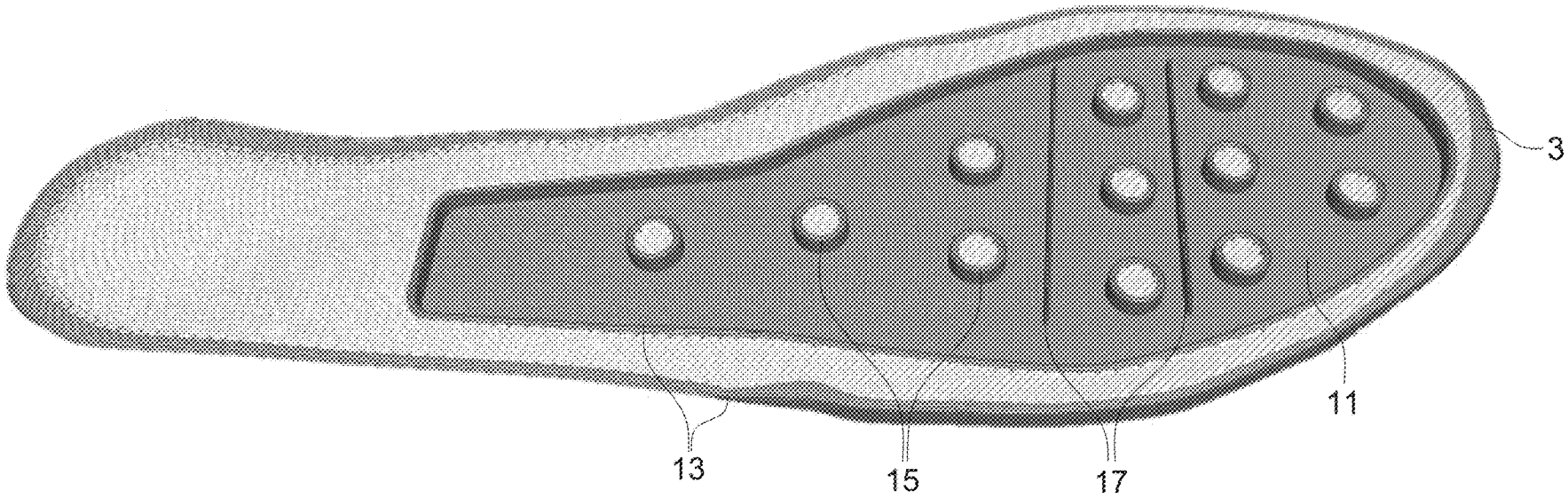
FIG. 2 depicts a cross-section of an exemplary insole (1), which shows a cavity (11) that spans from the front (3) to the middle (5) of the insole (1). The cavity (11) includes a wall (13), pillars (15), and baffles (17).
Figure 3:
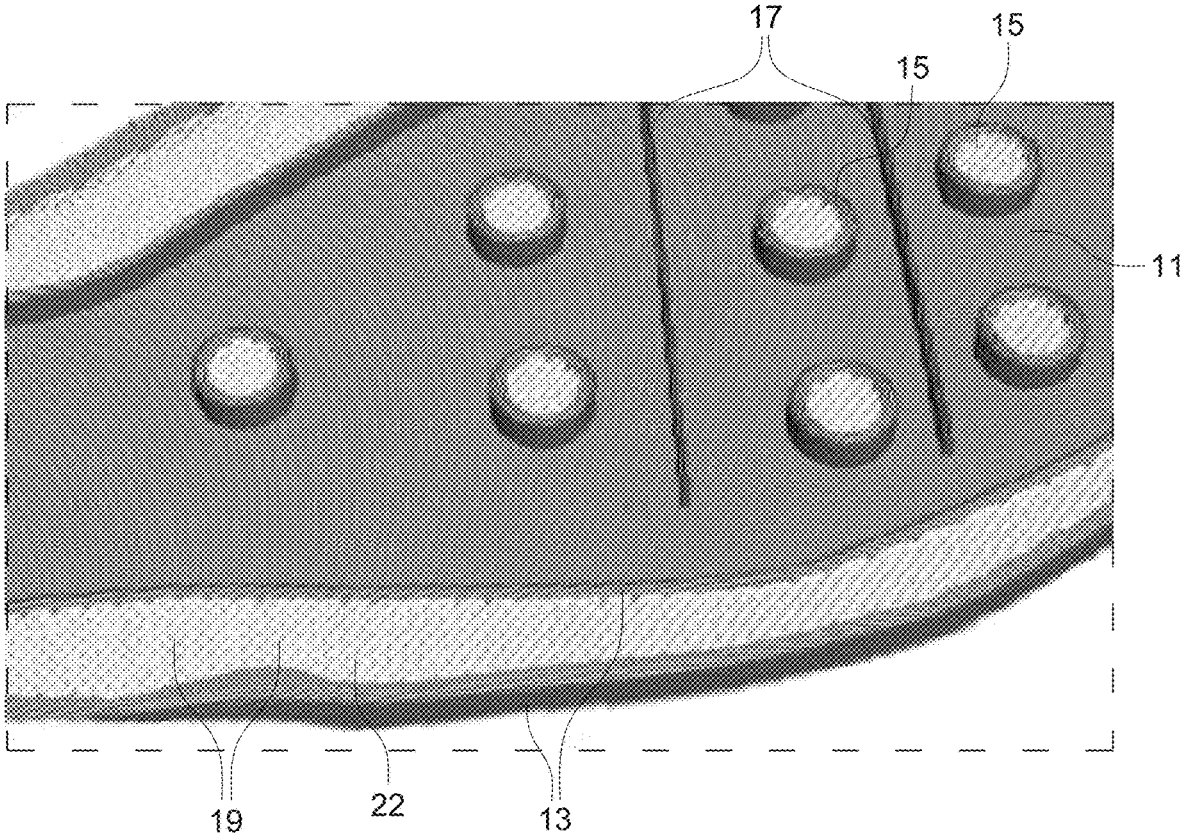
FIG. 3 depicts a close-up view of the cross-section of the insole (1), which shows spaces (19) located on the pillars (15), wherein the spaces (19) are located between the edge (9) of the insole and wall (13) of the cavity (11) as well as baffles (17)

In some embodiments, the one or more cavities have a wall (13) as shown in the embodiments of FIGS. 2 and 3. The wall (13) acts as support for the insole (1) and may prevent the component capable of a physiochemical reaction that is contained within the one or more cavities (11) from leaking. The wall (13) can be of varying thickness. In one aspect of the embodiment, the wall may function as the physical kinetic inhibitor to the physiochemical reaction by, for example, blocking airflow from reaching the component capable of a physiochemical reaction.

In other embodiments, the one or more cavities may not have a wall as shown in the embodiments of FIGS. 7 and 8. The cavities without a wall permit oxygen flow through the insole structure which reaches the component capable of a physiochemical reaction, potentially inducing the physiochemical reaction.

For heating purposes, the component capable of a physiochemical reaction may produce a reversible exothermic chemical reaction or a non-reversible exothermic chemical reaction. The exothermic reactions may comprise any physiochemical reactions capable of producing heat, including but not limited to reactions generated by PCMs or an iron oxidation mixture. For example, the reversible exothermic reaction releases heat until a thermal equilibrium is achieved. Examples of suitable PCMs may include, but are not limited to sodium acetate trihydrate, supersaturated sodium acetate trihydrate or hydrated copper sulfate. It is understood that any chemicals that are capable of carrying out heat producing reactions fall under the term exothermic. For example, hydrated copper sulfate is able to conduct an exothermic crystallization reaction. In one aspect of the invention, the component capable of a physiochemical reaction comprises a solution of sodium acetate trihydrate, hydrated copper sulfate, an iron oxidation mixture, or a combination thereof, and wherein the component is capable of the exothermic reaction. In an embodiment, the component capable of a physiochemical reaction comprises an iron oxidation mixture which can be oxidized by oxygen molecules that may be provided by air flow through the cavities. In such an embodiment, the physiochemical reaction may be non-reversible and the insole may be a one-time use insole.

Where the component capable of an exothermic physiochemical reaction further comprises at least one physical kinetic inhibitor, the physical kinetic inhibitor may tailor the duration of the reaction and/or the amount of heat release and/or the reversibility of the exothermic reaction. In one embodiment, the physical kinetic inhibitors may be walls surrounding at least one of the structures that comprises the one or more cavities, the baffles, the pillars or the insole which contain the component capable of a physiochemical reaction (FIGS. 2 and 3). Walls may be used as physical kinetic inhibitors when the physiochemical reaction of the component capable of a physiochemical reaction is reversible. In one aspect of the embodiment, the component capable of the reversible physiochemical reaction comprises at least one PCM. In another aspect of the invention, the component capable of reversible physiochemical reaction may also include at least one chemical kinetic inhibitor to extend the duration of the reaction or alter the nature of the warming sensation produced. For the exothermic, non-reversible configuration of the insole, the component capable of a physiochemical reaction may include an iron oxidation mixture or other component capable of producing heat in a non-reusable manner. In one aspect of the invention, the physiochemical reaction is facilitated by oxygen, which may be provided from airflow in the one or more cavities.

For cooling, the component capable of a physiochemical reaction may produce a reversible endothermic chemical reaction. The component may comprise a solution that is capable of the endothermic reaction. The endothermic reactions may comprise any physiochemical reactions capable of absorbing heat, including but not limited to reactions generated by PCMs. Examples of suitable PCMs may include but are not limited to PCM gel-like substances. It is understood that any chemicals that are capable of carrying out heat absorbing reactions fall under the term endothermic. In one aspect of the invention, the component comprising at least one PCM capable of absorbing heat energy may further comprise at least one physical kinetic inhibitor, which may be in the form of walls surrounding the structures containing the component capable of a reversible physiochemical reaction. Such physical kinetic inhibitors tailor the reaction to absorb variable amounts of heat for variable durations of time depending on the wearer's need. In another aspect of the invention, the component capable of physiochemical reaction may also include at least one chemical kinetic inhibitor to extend the duration of the reaction or alter the nature of the cooling sensation produced.

In some embodiments, the component capable of a reversible physiochemical reaction comprises at least one PCM. In one aspect, the at least one PCM releases and absorbs a large amount of heat within a temperature range, preferably between the ambient temperature and threshold of pain. When the component capable of a physiochemical reaction is heated to the transition temperature of the at least one PCM, in one aspect of the invention, the at least one PCM absorbs heat energy as it changes from a solid state to a liquid state, thus producing cooling. When the component capable of a physiochemical reaction is cooled to a temperature that falls below the transition temperature of the at least one PCM, in one aspect of the invention, the at least one PCM converts back to a solid-state releasing heat energy, thus producing warmth. For example, the heat energy absorbed by the component may come from the wearer's feet; the heat energy may be transferred from the feet to the component through insole materials (s), thus producing cooling. In another example, the heat energy stored in the component is released, diffused through the insole and transferred to the feet of the wearer, thus providing a warmth. Because of the dynamic nature of phase-changes, the component capable of a physiochemical reaction stores the warmth of the wearer's feet and can release the heat back. The heat exchange from the insole (1) containing the component capable of physiochemical reaction comprising at least one PCM creates an efficient buffer against the variations of temperature of the wearer's feet due to activities or the environment and provides comfort to the wearer. In one embodiment, the component capable of a reversible physiochemical reaction is contained in enclosed structures including the cavities (11), the baffles, the pillars or the insole itself. Physical kinetic inhibitors may also be included in an insole comprising a component capable of controlling the rate of reaction of a reversible physiochemical reaction.

In some embodiments, to improve the properties of the component capable of a physiochemical reaction, the component comprising at least one PCM may further comprise at least one additional reactant. Reactants may be defined as chemical inhibitors including, but not limited to propylene glycol, ethylene glycol, or other high latent heat capacity inhibitors that function to control the effective heat releasing duration and/or alter the maximum heat releasing temperature. The component may also comprise a catalyst to facilitate the physiochemical reaction.

In some embodiments, at least one kinetic inhibitor may also be used to tailor the physiochemical reaction and produce variable amounts of heat for variable heat releasing durations. Without being wed to any particular theory, it is believed that kinetic inhibitors may increase the duration the reaction and/or heat release through the addition of inhibitory nucleation sites within the component capable of a physiochemical reaction. In certain embodiments, nucleation may trigger crystallization in a PCM which may impede the release and recovery of the stored heat. As a result, the rate of the total reaction is slowed or certain portions of the one or more cavities (11) react slower than others. The insole can further include a support structure. Support structures include, but are not limited to, pillars (15) and/or baffles (17).

In an embodiment of the invention, the support structure contains one or more pillars (15).

Pillars (15), as used in the context of the present disclosure, refer to structures in the insole (1) that function, for example, to partially carry the weight of the wearer. The pillars (15) may have several functions, e.g., a) to ensure the pressure of the foot of the wearer onto the insole (1) does not force the component capable of a physiochemical reaction away from or out of the cavity (11), b) to provide comfort to the wearer by, e.g., distributing the pressure of the foot of the wearer across the pillars (15) and/or c) to function as physical kinetic inhibitors. As such, the pillars (15) surprisingly solve the deficiency of existing heating and cooling gel pad insoles, which are prone to burst from the sudden pressure imposed by sports users in any active event.

The pillars (15) can be located anywhere in the insole (1), but are preferably deployed within the one or more cavities (11). The pillars (15) can be any shape, including, but not limited to, circular, elliptical, triagonal, and rectangular. The number of pillars (15) present in the insole (1) will depend, for example, on the shape/size of the pillars and/or on the expected weight of the user. For example, smaller insoles (1) will contain fewer pillars (15), or even zero pillars (15), as compared to larger insoles (1) and larger pillars may permit fewer pillars to be included in the insole. Although preferably the same height as the cavities (11), the pillars (15) may be of varying height and/or widths to provide desired support to the foot. For example, pillars (15) in the arch may be taller to provide a raised arch effect for the insole (1). The position of the pillars (15) may be chosen to provide weight bearing support to those portions of the foot most in contact with the insole; for example, pillars (15) are preferably located to support the front of the metatarsal bones. Fewer pillars (15) may be located in other regions that come in less contact with the insole such as the arch. In some embodiments, the orientation and dimensions of the pillars (15) is chosen to optimize comfort while allowing sufficient volume in the cavities for the component capable of a physiochemical reaction. In one aspect of the invention, the pillars (15) are aligned diagonally with the plantar plate. In certain embodiments, the pillars can be customized to the wearer. The pillars (15) may be of the same material or different material as compared to the majority of the insole for the support and comfort of the wearer. For example, softer materials may be desired for applications for those with ailments or tired feet while stiffer material may be used for athletic applications. Additionally, the materials may be chosen to establish permeability.

In an embodiment of the invention, the support structure contains one or more baffles (17).

Baffles (17), as used in the context of the present disclosure, refer to structures within the cavity/cavities (11) of the insole (1) that restrain or dampen the flow of the component capable of a physiochemical reaction when the insole (1) is in motion. The baffles (17) suppress the effects of slosh dynamics which are characterized by inertial waves of a fluid in an open cavity volume. The baffles (17) may be barriers that physically decelerate or hinder fluid movement in the at least one cavity. The baffles may prevent the component capable of a physiochemical reaction from excessive movement within the one or more cavities (11) and deformation of the insole (1). The baffles (17) may also regulate the physiochemical reaction by lengthening the reaction time or maintaining a more desirable temperature.

In certain embodiments, the baffles (17) are deployed within the one or more cavities (11). The baffles (17) can be located anywhere in the one or more cavities (11), but are preferably located between the pillars (15). The baffles (17) can be oriented in any direction and/or can span across a cavity in any direction.

The baffles (17) are of variable height, thickness, number, and placement to optimally restrict fluid flow. In some embodiments, it is beneficial to retain liquid connectivity throughout the insole to facilitate heat transfer by convection. For example, the baffles within a cavity may not be connected to the wall of the cavity to allow the free flow of the component capable of a physiochemical reaction throughout the cavity which facilitates heat diffusion and heat transfer. In other embodiments, it may be desirable to slow down the rate of heat convection by building baffles that are connected to the wall of the cavity, thus creating barriers restricting the movement of the component. Similarly, in some embodiments, the baffles do not span the height of the cavity allowing movement of the component over the partial height baffles. In other embodiments, the baffles span the entire height, thus restricting the flow of the component The baffles may be separate from each other. The number of baffles is chosen primarily to minimize slosh while leaving maximum volume for the subject fluid. In some embodiments, the baffles are shorter at the center to accommodate the natural bending of the insole which provides comfort and ensures an even spread of the reactive material within the cavity.

In a preferred embodiment of the invention the support structure includes one or more pillars (15) and one or more baffles (17) as shown in FIG. 2. The insole (1) of the embodiment of FIG. 2. has 12 circular pillars (15) deployed throughout one cavity (11), wherein the cavity spans from the front (3) to the middle (5) of the insole (1), with ten circular pillars (15) deployed in the front (3) and two pillars (15) deployed in the middle (5); in the preferred embodiment a diagonal alignment to support the weight bearing front of the metatarsal bones. As shown in FIG. 2 there are two baffles (17) deployed in the front (3) of the insole (1). One baffle (17) is deployed between two rows of three pillars (15), and one baffle (17) is deployed between a row of two pillars (15) and a row of three pillars (15).

The term physiochemical reaction in the context of a component capable of a physiochemical reaction, refers to a variety of types of reactions. One type of physiochemical reaction is an irreversible exothermic reaction that produces iron oxide ($Fe_2O_3$) and releases heat. In an embodiment, an irreversible exothermic reaction can occur by allowing oxygen flow throughout the one or more cavities (11). In one embodiment, this may be achieved by adapting the pillars (15) and removing the walls to permit oxygen flow through the pillars (15) and thus, throughout the one or more cavities (11). If more oxygen is needed, the layers on top of the pillars and/or the sides of the insole and/or the entire insole can have a gyroid shape structure which may allow more oxygen to flow and react with the component capable of physiochemical reaction. For reversible physiochemical reactions which involve at least one PCM, walls can be created around the one or more cavities (11) and/or the pillars (15) which may trap temperature change within the insole. Depending on the physiochemical reaction, it may be advantageous to have the oxygen pass through to the one or more cavities (11) in a limited/steady rate.

In an embodiment of the invention, the one or more cavities of the invention comprise an infill structure (22) which include spaces (19). Spaces, as used in context of the present disclosure, refer to repeating shapes in the insole (1) as shown in FIG. 9. In one aspect of the invention, the spaces are filled with air and may function as thermal insulators by reducing the loss of heat energy that is transferred through the insole. The greater the number of spaces in the infill (22) of the insole, the greater the insulation effect. Since air has low thermal conductivity, the spaces filled with air may also slow the thermal conductivity rate. In another aspect of the invention, the spaces may affect the cushion and/or support of the insole. The density of these spaces is variable to achieve the desired thermal insulation and cushioning feel of the insole. In one embodiment, the spaces allow oxygen molecules to pass through the infill (22) to reach the component capable of a physiochemical reaction housed in the one or more cavities. The spaces (19) can have any shape, including, but not limited to, gyroid, circular, elliptical, triagonal, honeycomb, and rectangular. The spaces (19) can be of any size and may comprise part of the overall structure of the insole (1). In one embodiment, there are a multitude of spaces (19) present in the insole (1). Preferably the spaces (19) are micro-spaces (19). In one embodiment, the spaces have a gyroid structure which provides a path for the component capable of the physiological reaction and prevents its escape from the at least one cavities while letting small oxygen molecules to easily slip through as seen in FIG. 7. In another embodiment, the spaces have a honeycomb-like structure (22) as seen in FIG. 8.

In some embodiments, the density of the gyroid infill (22) can be varied to optimize oxygen flow. The gyroid infill (22) can be printed with any specified density by a 3D printer. A higher density of gyroid infill allows less air (oxygen) flow into and out of the insole. In such an embodiment, the paths through the gyroid are smaller and the gaps (spaces) created by the gyroid repeating shapes are smaller. In contrast, a lower density allows more air flow into and out of the insole. In such an embodiment, the paths through the gyroid are larger. The gaps (spaces) created by the gyroid repeating shape are larger. Furthermore, the density and permeability of the infill structure may be varied throughout the insole.

In one preferred embodiment, the infill (22) of a non-reusable insole has a gyroid structure that allows oxygen molecules to reach the component capable of an irreversible physiochemical reaction comprising a chemical that releases energy when oxidized as shown in FIG. 7. For example, the chemical is an iron oxidation mixture. In such an embodiment, the insole (1), the one of more cavities (11), and/or the pillars (15) are not enclosed by walls, which allows the airflow and the exothermic irreversible physiochemical reaction to occur. For the irreversible reaction, the infill density may be, for example, approximately 90-96%. This allows very small gaps of airflow from the outside to the main cavity. The pillars may have small gaps at the top. The pillars may not have a solid top surface and/or solid side surfaces as shown in the embodiments of FIGS. 7-9. In such an embodiment, the airflow path may occur downward through the pillars (that do not have a solid top surface), out the sides of the pillars (that do not have solid walls) and into the one or more cavities. The complex shape of the pillars creates a tortuous path for the component capable of an irreversible physiochemical reaction, which prevents the component from escaping. Additionally, gravity helps the irreversible component to remain in the one or more cavities. Because the overall insole is of variable density, these spaces allow for a very light insole that still retains surprising tensile strength due to its three-dimensional repeating structure, especially in the case of the gyroid structure. (See FIG. 7) The gyroid structure can absorb and withstand tension from any direction. The gyroid separates space into oppositely congruent labyrinths of passages. Moreover, the gyroid structure maintains permeability.

In some embodiments, the sides of the front part of the insole may have no walls. The insole may comprise 96% density of infill, e.g., gyroid infill (22). An airflow path may proceed through the sides, through the insole gyroid perimeter, and into the main cavity. The structure of the insole may be designed to optimize airflow based upon the wearer's shoe material, permeability, ambient conditions, and activities. It is apparent in the field which shoes are preferred for such an embodiment.

In another preferred embodiment, the infill (22) of a reusable insole can have repeating spaces, e.g., repeating gyroid spaces, or a honeycomb structure. In such embodiment, the density of the infill structure may be 100%. The infill (22) may be airtight and/or impermeable, such that no fluid can leak in or out of the one or more cavities (11). In one aspect of the embodiment, the insole (1), the one or more cavities (11) and/or the pillars (15) are enclosed by walls (13) to prevent any leakage and retain the component capable of a reversible physiochemical reaction comprising at least one PCM as shown in FIGS. 2-3.

The spaces (19) can be present anywhere in the insole (1) to provide insolation, structural support and air flow throughout the infill (22) of the insole (1). The spaces (19) may manage energy (heat) transfer from the component capable of a physiochemical reaction and extend the ability of the insole (1) to keep the foot of the user at the desired temperature. For example, the spaces (19) may be configured for additional retention or deflection of heat from the insole depending on the desired temperature for the user. The spaces (19) can include a thermal or chemical break.

In the exemplary embodiment of FIGS. 2-5, the spaces (19) are about 100-200 μm wide and are rectangular in shape. In the exemplary embodiment shown in FIG. 2, there are a multitude of spaces (19) throughout the insole (1); there are spaces (19) located in the heel (9) of the insole (1) and there are spaces (19) located between the wall (13) of the cavity (11) and the edge (9) of the insole (1). In the exemplary embodiment shown in FIG. 3. there are spaces (19) located at the pillars (13) in the cavity (11) of the insole and spaces between the wall (13) of the cavity (11) and the edge (9) of the insole.

In certain embodiments, the one or more cavities (11) of the insole (1) are enclosed with layers (20) located above and below the one or more cavities (11). The layers (20) act as support for the insole (1) and also protect the component capable of a physiochemical reaction that is within the one or more cavities (11). In one aspect of the invention, the layers (20) may ensure the component capable of a physiochemical reaction is separate from the rest of the insole (1) and prevent leakage. The layers (20) can be of varying thickness and length. The layers can also comprise pockets (19). An exemplary layer (20) is shown in FIG. 4. with a surface (21). FIG. 5. shows a close up of the layer (20) which has a multitude of pockets (19) across its surface (21). The material separating the layers may vary. One material may be stiffer than other materials used in the insole to withstand wear of the insole in portions of the insole that are more prone to wear. Exemplary models of the insole contain upper layers of the top front of the insole (1) that may be of a thermoplastic polyurethane (TPU) material that is stiffer and more durable than other parts of the insole to withstand the abrasion of the user's foot.

Methods to produce foot inserts have historically utilized the standard procedure of heat compressing multiple different layers in a sandwich method. In certain embodiments, methods of manufacturing the insoles of the invention may use utilize inner and outer structures that may not require heat compression. In some embodiments, the outer structure is shaped into a standard shoe insert (insole (1)) while the inner structure comprises one or more cavities (11). In one aspect of the embodiments, the outer structure is slightly curved to help stabilize the insole's position within the shoe. The outer structure may also contain a heel cup to stabilize the foot within the insole (1). In other embodiments, the inner structure is comprised of one or more cavity(s) (11) that are typically positioned toward the forefoot to heat or cool the toes. The one or more cavity(s) (11) may also be positioned anywhere that the end user might desire. The inner structure may also be positioned anywhere along the insole (1) that does not consist of the forefoot. Advantageously, the insole (1) may be used repeatedly since the component capable of a physiochemical reaction housed in the one or more cavities of the insole can reversibly phase change In certain aspects, the insole (1) may be made using a multitude of different techniques including, but not limited to 3-D printing, injection molding or other manufacturing techniques well known in the art. In one aspect of the invention, the insoles are produced using 3-D printing resulting in, for example, a product having a potentially stronger internal structure, more efficient distribution of energy (temperature flow), and enhanced insulation. 3D Manufacturing also may allow for customization for the wearer of the insoles (1). Such method advantageously may allow for sub-millimeter designs, which are not possible with other techniques. 3D printing may produce ergonomic designs of the insoles (1) such as heel cups and arches to provide cushioning and support. The density of selected portions of the insole (1) may also be adjusted as desired for the benefit to the wearer. However, the time of production using current 3D printing may not be optimal. In some embodiments, the insoles (1) are produced by injection molding which is a rapid manufacturing process. Injection molding may lack the specificities of the design produced by 3-D printing, especially for thin insoles (1) which may require accurate sub-millimeter measurements. In some embodiments, the component capable of a physiochemical reaction is sealed between the inner and outer structures and as such does not require additional packaging. The inner and outer structures protect the component and may prevent water uptake, abrasion and leakage.

The material for the insole can be comprised of different materials or filaments. In some embodiments, the insole (1) is made of materials that may include, but are not limited to, thermoplastic elastomer (TPE), thermoplastic polyurethane (TPU), polypropylene, or TPU foam. In certain embodiments, TPE does not require vulcanization or curing which is advantageous for producing the insole of the invention. TPE may also provide comfort. In one aspect of the invention, the Shore Hardness may preferentially range from 70A-100A, to provide a truly flexible feel with a hardness that prevents leakage of the component capable of physiochemical reaction. Flexibility, advantageously, allows for repeated movement and impact without wear or cracking. In other embodiments, the insole may be comprised of a material that provides durability, bounce and recoil such as, for example, TPU. In another embodiment, the insole may be made of a combination of materials. For example, TPU filament may be used to make the insole (1) and TPE may be used to make the pillars (15) and/or baffles (17) or vice versa. Using multiple materials may improve temperature regulation and/or structural support. The selection of materials is based on a multitude of factors including thermal conductivity, desired flexibility and hardness to prevent leakage of the component. While good flexibility of the insoles is advantageous, especially for athletes, the thermal conductivity of the insole materials facilitates heat transfer. Within the insole, heat energy moves along a temperature gradient from an area of high temperature to an area with lower temperature. Heat transfer stops when thermal equilibrium is reached. The rate at which heat is transferred is dependent on the specific thermal characteristics of the materials of the insole. Accordingly, the insole materials may be selected to display optimized heat transfer performance to facilitate heat transfer from or to, e.g., the feet of the wearer.

An insole according to the invention may be produced using a fused deposition modeling (FDM) 3d printer to lay one layer of TPU (thermoplastic polyurethane) on top of a previous layer. For example, the insole can be built vertically laying down approximately 100 layers of material. Variable densities of material may be used in the insole. In an embodiment, the heel of the insole comprises a lower density (to provide softness and comfort), the arch comprises a higher density (to provide arch support), and the front comprises of an intermediate density.

Inside the one or more cavities (11) comprising the component capable of a physiochemical reaction, there is a plurality of baffles (17) deployed within one or more cavities (11), in between the pillars (15). The plurality of baffles (17) may partially restrict the flow of the component and any other reactants thereby reducing movement of the component within the insole (1). The baffles (17) may advantageously overcome the deficiency of the heating and cooling gel pouches of the prior art that are simply laid on top of insoles. Moreover, the gel within the prior art pouches moves around and is uncomfortable to a user. The insoles according to the invention solve the problems of the prior art. Additionally, the baffles (17) may also regulate the kinetics of the physiochemical reaction within the component and may lengthen the effective time or maintain a more desirable temperature.

A further embodiment of the invention is directed to a method of heat transfer between an article of footwear and a foot of a wearer comprising priming the insole of the invention by initiating a physiochemical reaction. In such an embodiment, the priming of the insole may comprise cooling the insole to a temperature of less than ambient temperature. In another aspect of the invention, the priming of the insole comprises heating the insole to a temperature of greater than ambient temperature. In yet another aspect of the invention, the method of heat transfer comprises a catalyst for the priming of the insole, preferably the catalyst initiates the physiochemical reaction.

An embodiment is directed to a method of heat transfer between an article of footwear and a foot of a wearer comprising an irreversible physiochemical reaction intended for one-time use. In another aspect of the invention, the aspects comprising this irreversible chemical reaction can be removed and replaced for further use, or the entire embodiment may be disposed. In the preferred embodiment, an irreversible reaction containing iron powder, salt, water, an absorbent material, and activated carbon/charcoal would be present in the cavity of the insole whose infrastructure is selectively permeable to oxygen. With salt and water present as the absorbent material, the oxygen reacts with the iron powder located inside to form iron oxide ($Fe_2O_3$) which releases heat. The absorbent material can be pulverized wood, a polymer such as polyacrylate, or a silicon-based mineral called vermiculite. It helps retain the moisture so that the reaction can occur at a sustainable rate. In a manner that allows for a sustainable, exothermic oxidation reaction.

In a particular embodiment, the component capable of an irreversible physiochemical reaction comprises iron powder, salt, water, an absorbent material, and activated carbon/charcoal. All materials that are either provided separate or mixed can be placed within the at least one of more cavities (11). In one embodiment, when removed from its packaging, the insole is exposed to oxygen. Oxygen may gain access to the invention's one or more cavities through a permeable infill (22) structure having space (19) of gyroid shapes of the pillars as shown in the embodiment of FIG. 7. With salt and water present, the oxygen can react with the iron powder located inside to form iron oxide ($Fe_2O_3$) which releases heat. Nonlimiting examples of the absorbent material are pulverized wood, a polymer such as polyacrylate, or a silicon-based mineral called vermiculite. Absorbent materials can help retain moisture which may result in the physiochemical reaction occurring at a sustainable rate.

It is understood that various changes could be made to the above-described insoles and methods without departing from the spirit and scope of the invention. It is intended that the above description and examples provided below are to be interpreted as illustrative and nonlimiting.

EXAMPLES

An insole according to the invention was produced using a Fused Deposition Modeling (FDM) 3D Printer to lay one layer of TPU (thermoplastic polyurethane) on top of a previous layer. Approximately 100 layers were laid down and the insole was constructed vertically. Variable densities of material were used in the insole. In one insole the heel had a lower density (to provide softness and comfort), the arch had a higher density (to provide arch support), and the front had an intermediate density. The inner structure was composed of repeating strong yet flexible shapes called gyroids.

Other 3D printer technologies, such as SLS and SLA 3d printing, may be used to produce the insole. Injection molding techniques of Overmolding (for complex parts) and Two Shot Molding (for multiple materials) may be used. Over-molding may be used to make the various parts of the insole (main insole, cavity, support). Two Shot molding may be used to accommodate two materials in the insole for targeted densities. Injection molds may use these molding techniques but other ways are also possible.

An insole according to the invention was produced which achieved a beneficial temperature within minutes of activation. One example of an insole according to the invention comprising an iron and oxygen nonreversible physiochemical reaction resulted in elevated temperature for a period on the order of 10 hours. In another example, a therapeutic user of an insole according to the invention experiences cooling by the endothermic reversible physiochemical reaction for 45 minutes, resulting in reduced pain from burning feet associated with diabetes for a total of approximately one hour. Additionally, a collegiate athletic user of an insole according to the invention experiences benefit of the exothermic reversible reaction for an entire outdoor training session of two hours.

The invention claimed is:

1. An insole comprising one or more cavities, one or more layers, one or more spaces and a component capable of a physiochemical reaction, wherein said one or more cavities is enclosed within said one or more layers, wherein said component capable of a physiochemical reaction is within said one or more cavities, and wherein said one or more spaces is on a surface or of or within the one or more layers.

2. The insole of claim 1, wherein the insole further comprises a support structure.

3. The insole of claim 2, wherein the support structure comprises one or more pillars.

4. The insole of claim 2, wherein the support structure comprises one or more baffles.

5. The insole of claim 2, wherein the support structure is configured to initiate the physiochemical reaction.

6. The insole of claim 5, wherein the support structure comprises the spaces and wherein the spaces allow oxygen to enter the insole, and towards the cavity to initiate the physiochemical reaction.

7. The insole of claim 1, wherein the spaces have a density capable of insulating the one or more cavities.

8. The insole of claim 7, wherein the density of the spaces comprise a thermal break or a chemical break.

9. The insole of claim 1, wherein the one or more cavities have a volume that is greater than a volume of the component.

10. The insole of claim 1, wherein the component capable of a physiochemical reaction of the insole provides heat and/or absorbs heat.

11. The insole of claim 1, wherein the component comprises at least one phase change material (PCM).

12. The insole of claim 11, wherein the PCM is capable of an exothermic chemical reaction and/or an endothermic chemical reaction.

13. The insole of claim 12, wherein the exothermic chemical reaction is reversible or the endothermic chemical reaction is reversible.

14. The insole of claim 1, wherein the component comprises a solution of sodium acetate trihydrate, hydrated copper sulfate, an iron oxidation mixture, or a combination thereof, and wherein the component is capable of the exothermic reaction.

15. The insole of claim 1, wherein the component comprises a saline solution, and wherein the component is capable of the endothermic reaction.

16. The insole of claim 1, wherein the component further comprises a kinetic inhibitor or a physical inhibitor.

17. The insole of claim 1, wherein the component further comprises a catalyst.

* * * * *